US005244186A

United States Patent [19]

Chandler

[11] Patent Number: 5,244,186

[45] Date of Patent: Sep. 14, 1993

[54] REMOVABLE HANDRAIL MOUNTING BRACKET ASSEMBLY

[76] Inventor: Herman R. Chandler, 31 Shafor Cir., Dayton, Ohio 45409-2337

[21] Appl. No.: 939,308

[22] Filed: Sep. 2, 1992

[51] Int. Cl.[5] ..... E04H 17/00

[52] U.S. Cl. ..... 256/65; 256/68; 256/69; 248/223.4; 248/251; 403/407.1

[58] Field of Search ..... 256/65, 68, 69, 59, 256/60-64, 66-67, 70-72; 248/251, 225.1, 223.4; 403/375, 405.1, 406.1, 407.1

[56] References Cited

U.S. PATENT DOCUMENTS

| | | | |
|---|---|---|---|
| 1,286,376 | 12/1918 | Madsen | 248/251 X |
| 2,886,278 | 5/1959 | Opie | 256/65 X |
| 3,596,861 | 8/1971 | Baldini | 248/223.4 |
| 3,631,572 | 1/1972 | Lange | 248/223.4 X |
| 4,181,293 | 1/1980 | Laribee | 256/67 |
| 4,613,135 | 9/1986 | Rush | 248/223.4 X |
| 4,650,164 | 3/1987 | Shepherd | 256/68 |
| 4,835,852 | 6/1989 | Asplund et al. | 29/464 |
| 4,856,761 | 8/1989 | Berner | 256/59 |
| 5,026,013 | 6/1991 | Robbins | 248/251 X |

FOREIGN PATENT DOCUMENTS

| | | | |
|---|---|---|---|
| 1041247 | 9/1966 | United Kingdom | 248/223.4 |

*Primary Examiner*—Randolph A. Reese

*Assistant Examiner*—Harry C. Kim

*Attorney, Agent, or Firm*—John R. Flanagan

[57] ABSTRACT

A removable handrail mounting bracket assembly includes a wall mounting member and a removable bracket member. The wall mounting plate is intended to be permanently mounted to a wall surface. The removable bracket member is intended to be permanently attached to the underside of a handrail. The wall mounting member has a pair of spaced longitudinal side portions adapted for attachment to the wall surface and a longitudinal middle portion extending between and interconnecting the side portions. The bracket member has a base portion adapted to overlie and cover the wall mounting member and an arm portion rigidly attached at an inner end to the base portion and extending in a cantilevered relationship therefrom to an outer end adapted for attachment to a handrail. Complementary structures are respectively defined on the middle portion of the wall mounting member and on the base portion of the removable bracket member for releasably connecting the removable bracket member to the wall mounting member for converting the removable bracket member from a disengaged position to an engaged position relative to the wall mounting member to thereby convert the handrail from a dismounted position to mounted position relative to the wall surface.

18 Claims, 2 Drawing Sheets

FIG. 4
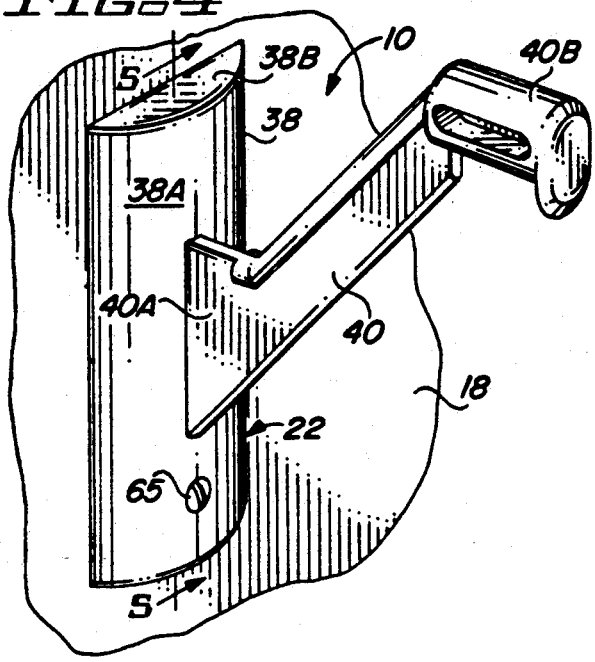
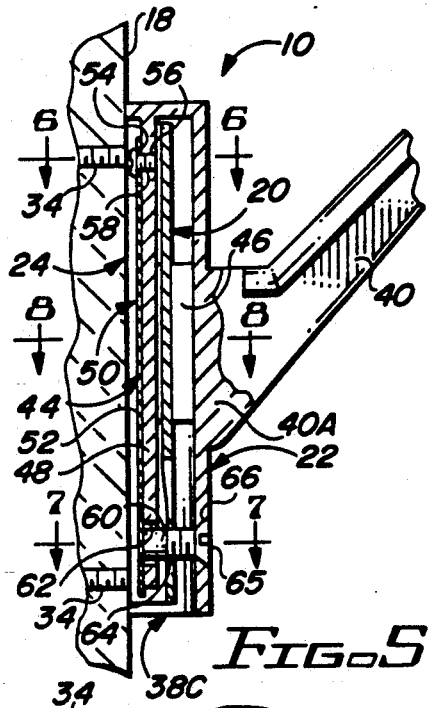
FIG. 5
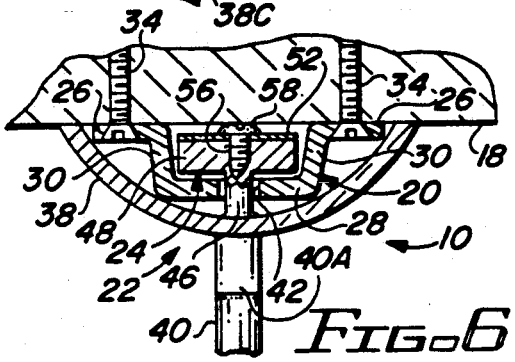
FIG. 6
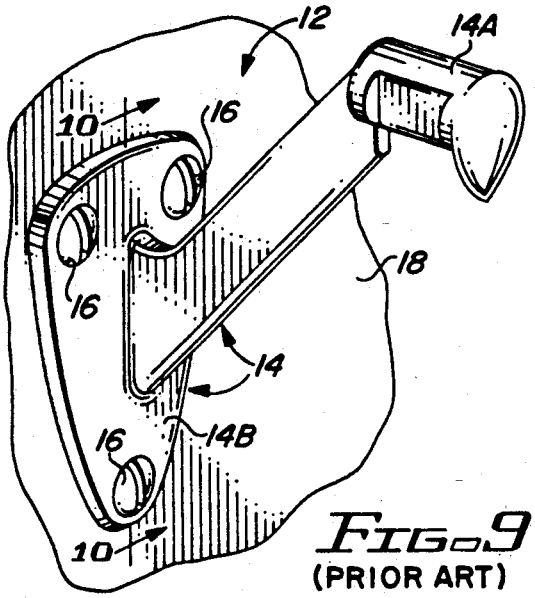
FIG. 9
(PRIOR ART)
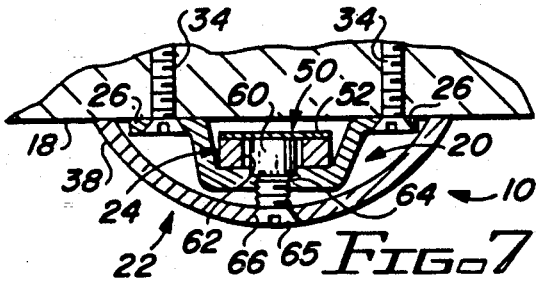
FIG. 7
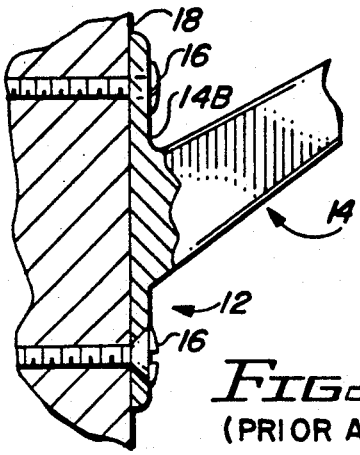
FIG. 10
(PRIOR ART)
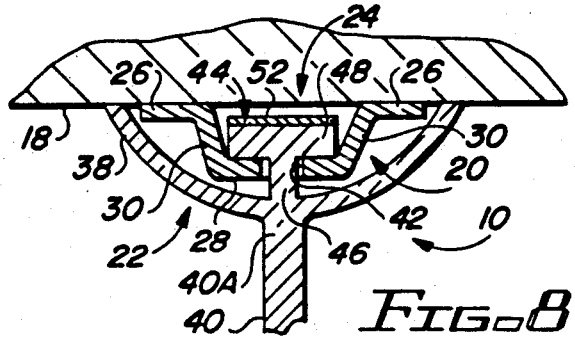
FIG. 8

REMOVABLE HANDRAIL MOUNTING BRACKET ASSEMBLY

BACKGROUND OF THE INVENTION

1. Field of the Invention

The present invention generally relates to handrails used in buildings, such as residential homes, and, more particularly, is concerned with a mounting bracket assembly for removably mounting a handrail to a building wall.

2. Description of the Prior Art

Handrails are used extensively on public and private stairway and hallway walls for convenience and safety. Most handrails are constructed from wood as elongated members shaped for a comfortable hand grip. The handrail is typically flattened on the bottom to provide a surface for attachment of the handrail to the wall by some form of mounting hardware.

One conventional set of mounting hardware includes a mounting strap, a one-piece wall mounting bracket and a plurality of screws. The mounting strap is attached, by using a pair of screws, to the flattened bottom of the handrail. The wall mounting bracket at one end interfits and connects with the mounting strap so as to be held by the mounting strap at the required angle for vertical mounting on the wall or other vertical surface. The wall mounting bracket is attached at an opposite end to the vertical wall surface using three wall attachment screws in a triangular arrangement. Two or more sets of mounting hardware are used on each handrail with each set being located to permit the three wall attachment screws to anchor into the wall framework.

When painting of the wall is to take place, the preferred practice is to remove the three wall attachment screws from each wall mounting bracket in order to remove the wall mounting bracket with the handrail from the wall to permit floor to ceiling roller or brush painting. The handrail is then acessible on all sides to be refinished also. A problem with this practice is that complete handrail and mounting hardware removal and reinstallation causes crushing of the wall material under the wall mounting bracket and necessitates screw hole repair after multiple removals.

A less desirable practice is to paint the wall as close as possible to the handrail and mounting hardware with the roller or brush, then attempt to paint the remaining wall and wall side of the handrail through the approximate two inch spacing between them. A problem with this practice is that non-removal of the handrail and mounting hardware prevents or restricts the painting of the handrail and wall surfaces.

Either practice requires twenty to thirty minutes of the painter's time and thus added labor cost of about one-half the hourly labor rate per each handrail at the work site. Wall repair of damage caused by repeated bracket removals is an additional cost. Consequently, a need still exists for an improved handrail wall mounting bracket design which will overcome the problems of the prior practices associated with the one conventional hardware design described above without introducing a new set of problems in their place.

SUMMARY OF THE INVENTION

The present invention provides a removable handrail mounting bracket assembly designed to satisfy the aforementioned need. The removable mounting bracket assembly of the present invention basically includes a wall mounting member and a removable bracket member. The wall mounting member is intended to be permanently mounted to the wall. The removable bracket member is intended to be permanently attached to the underside of a handrail and removably mounted to the wall mounting member.

The mounting bracket assembly of the present invention reduces the handrail removal time and thereby the labor costs associated therewith to near zero. The mounting bracket assembly also withstands unlimited removal and replacement of the handrail and the removable bracket member therewith and permits normal refinishing of the inner surface of the handrail and the wall surface extending between wall mounting members of adjacent mounting bracket assemblies which remain attached to the wall.

Accordingly, the present invention is directed to a removable handrail mounting bracket assembly which comprises: (a) a wall mounting member adapted for attachment to a mounting surface; (b) a bracket member having a base portion adapted to overlie and conceal from view the wall mounting member and an arm portion being rigidly attached at an inner end to the base portion and extending in a cantilevered relationship therefrom to an outer end being adapted for attachment to a handrail; and (c) complementary means respectively defined on the wall mounting member and on the base portion of the bracket member for releasably connecting the bracket member to the wall mounting member for converting the bracket member from a disengaged position to an engaged position relative to the wall mounting member to thereby convert the handrail from a dismounted position to mounted position relative to the mounting surface.

More particularly, the wall mounting member includes a pair of spaced apart longitudinal side portions lying in a common plane so as to adapt the side members for engagement against the mounting surface. The wall mounting member also includes a longitudinal middle portion extending longitudinally between and generally parallel to the side portions and being disposed in a spaced offset relationship to the common plane of the side portions.

Further, the complementary connecting means includes a slot defined longitudinally in the middle portion of the wall mounting member. The slot extends from an open upper end at a top edge of the middle portion to a closed lower end at a location spaced above a bottom edge of the middle portion. The complementary connecting means also includes an elongated latching member capable of interfitting with the middle portion of the wall mounting member along the slot therein upon movement of the bracket member from the disengaged position to the engaged position relative to the wall mounting member.

The mounting bracket assembly also comprises means mounted on the latching member for releasably locking the latching member to the middle portion of the wall mounting member. The locking means is a leaf spring mounted on the outer head portion of the latching member and having a protuberance being operable for releasably locking the latching member to the middle portion of the wall mounting member by being extendable through apertures in the outer head portion of the bracket member and the middle portion of the wall mounting member being aligned with one another when the bracket member is disposed at the engaged position relative to the wall mounting member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 4 is an assembled perspective front view of the removable handrail mounting bracket assembly of FIG. 1.

FIG. 5 is a fragmentary longitudinal sectional view of the mounting bracket assembly taken along line 5—5 of FIG. 4.

FIG. 6 is a cross-sectional view of the mounting bracket assembly taken along line 6—6 of FIG. 5.

FIG. 7 is another cross-sectional view of the mounting bracket assembly taken along line 7—7 of FIG. 5.

FIG. 8 is still another cross-sectional view of the mounting bracket assembly taken along line 8—8 of FIG. 5.

FIG. 9 is a perspective front view of a one-piece wall mounting bracket and a plurality of screws of a prior art handrail mounting hardware.

FIG. 10 is a fragmentary vertical sectional view of the prior art handrail mounting hardware taken along line 10—10 of FIG. 9.

DETAILED DESCRIPTION OF THE INVENTION

Figure 2:
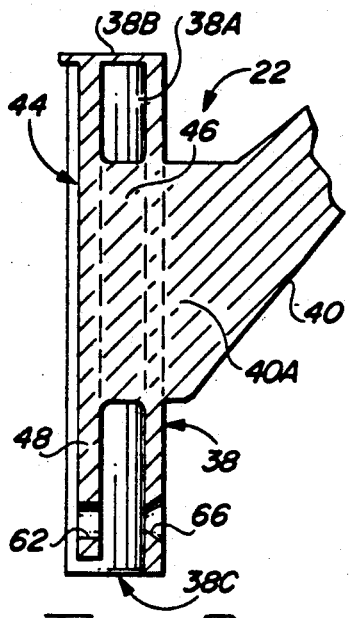
FIG. 2 is a fragmentary longitudinal sectional view of the removable bracket member of the mounting bracket assembly taken along line 2—2 of FIG. 1.
Figure 1:
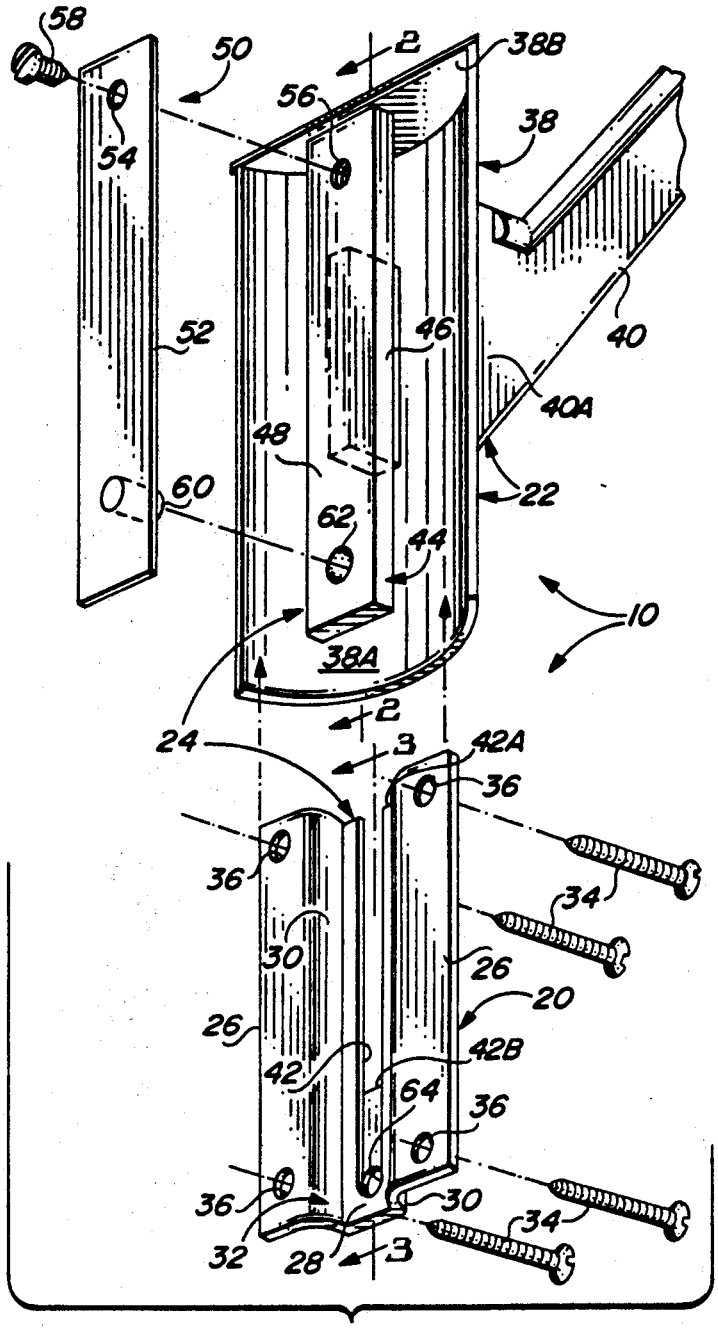
FIG. 1 is an exploded perspective rear view of a removable bracket member, a locking leaf spring and a wall mounting member of a handrail mounting bracket assembly of the present invention.
Figure 3:
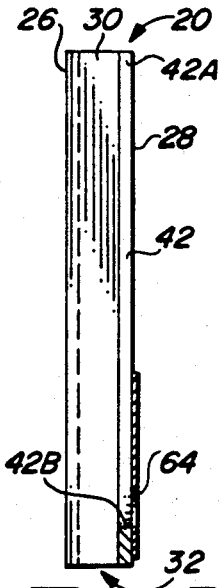
FIG. 3 is a longitudinal sectional view of a wall mounting member of the mounting bracket assembly taken along line, 3—3 of FIG. 1.

Referring to the drawings, and particularly to FIGS. 1 and 4, there is illustrated a removable handrail mounting bracket assembly of the present invention, being generally designated 10. The mounting bracket assembly 10 of the present invention provides the needed improvements, as described previously, over a prior art handrail mounting hardware 12 depicted in FIGS. 9 and 10.

Referring to FIGS. 9 and 10, the prior art mounting hardware 12 typically includes a one-piece wall mounting bracket 14 and a plurality of screws 16. The wall mounting bracket 14 is attached to a flattened bottom of a handrail (not shown) in a well-known conventional manner by a pair of screws (not shown) and a mounting strap (not shown). The wall mounting bracket 14 at one end 14A interfits and connects with the mounting strap so as to be held by the mounting strap at the required angle for vertical mounting on the wall surface 18. The wall mounting bracket 14 is attached at an opposite plate-like end 14B to the vertical wall surface 18 using three wall attachment screws 16. Two or more sets of the prior art handrail mounting hardware 12 are typically used for mounting each handrail.

Referring now to FIGS. 1–4, there is illustrated the removable handrail mounting bracket assembly, generally designated 10, of the present invention. The mounting bracket assembly 10 basically includes a wall mounting member 20 and a removable bracket member 22. The wall mounting member 20 is intended to be permanently mounted to the vertical wall surface 18. The removable bracket member 22 is intended to be permanently attached to the underside or bottom of the handrail by the prior art mounting strap in substantially the same manner as the prior art wall mounting bracket 10; however, the bracket member 22 is removably mounted by complementary releasable connecting means 24 to the wall mounting member 20 of the mounting bracket assembly 10.

The wall mounting member 20 of the mounting bracket assembly 10 is a one-piece component. The wall mounting member 20 includes a pair of spaced apart longitudinal side portions 26, a longitudinal middle portion 28 disposed between the side portions 26 and extending longitudinally between and generally parallel to the side portions 26, and a pair of intermediate portions 30 extending between and integrally interconnecting the side portions 26 to the middle portion 28. The side portions 26 lie in a common plane with one another, as can be seen in FIGS. 4–6, so as to adapt the side members 26 for flush placement and engagement against the vertical wall surface 18. The intermediate portions 30 interconnect the middle portion 28 at its opposite side edges with inner side edges of the side portions 26 such that the middle portion 28 is spaced from the common plane of the side portions 28 in an offset and generally parallel relationship thereto so as to define an elongated recessed channel 32 along a rear side of the wall mounting member 20, as can readily be seen in FIGS. 1 and 6-8. The intermediate portions 30 also extend in oppositely inclined relationships to one another from the common plane of the side portions 26.

Referring to FIGS. 1, 6 and 7, the wall mounting member 20 also includes means in the form of a plurality of fasteners, such as screws 34, and two pairs of spaced holes 36 defined through opposite end portions of the side portions 26. The screws 34 are insertable through the holes 36 and threadable into the vertical wall surface 18 for attaching of the wall mounting member 20 to the vertical wall surface 18.

Referring to FIGS. 1, 2 and 4-8, the removable bracket member 22 of the mounting bracket assembly 10 has a base portion 38 and an elongated arm portion 40. The base portion 38 is adapted to overlie, cover and conceal from view, the wall mounting member 20, The arm portion 40 is rigidly attached at an inner end 40A to the base portion 38 and extending in a cantilevered relationship therefrom to an outer end 40B adapted for attachment to the underside or bottom of the handrail by the prior art mounting strap in substantially the same well-known conventional manner as in the case of the prior art wall mounting bracket 10. The base portion 38 is in the form of an arcuate-shaped or curved front wall 38A and an end wall 38B attached across an upper end of the front wall 38A. As seen in FIG. 5, a lower end of the front wall 38A defines an opening 38C when the base portion 38 is placed against the vertical wall surface 18.

Referring to FIGS. 1–3 and 5–8, the complementary means 24 is respectively defined on the middle portion 28 of the wall mounting member 20 and on the base portion 38 of the bracket member 22 for releasably connecting the bracket member 22 to the wall mounting member 20 for converting the bracket member 22 from a disengaged position, as seen in FIG. 1, to an engaged position, as seen in FIGS. 4–8, relative to the wall mounting member 20 to thereby convert the handrail from a dismounted position to a mounted position relative to the vertical wall surface 18.

The complementary means 24 includes an elongated slot 42 defined longitudinally in the middle portion 28 of the wall mounting member 20. The slot 42 extends from an open upper end 42A at a top edge of the middle portion 28 to a closed lower end 42B at a location spaced above a bottom edge of the middle portion 28. The complementary means 24 also includes an elongated latching member 44 capable of interfitting with the middle portion 28 of the wall mounting member 20 along the slot 42 therein and along the recessed channel 32 at the rear side of the wall mounting member 20 upon movement of the bracket member 22 from the disengaged position of FIG. 1 to the engaged position of FIGS. 5–8 relative to the wall mounting member 20.

More particularly, the elongated latching member 44 includes an inner neck portion 46 and an outer elongated head portion 48. The inner neck portion 46 extends along and is rigidly attached to a longitudinal central region of the base portion 38 of the bracket member 22 for slidable movement along the slot 42 in the middle portion 28 when the bracket member 22 is moved between the disengaged and engaged positions relative to the wall mounting member 20. The inner neck portion 46 is only slightly narrower in width than the slot 42 so as to allow it to slidably extend through and move along the slot 42 as the as the bracket member 22 is moved between the disengaged and engaged positions relative to the wall mounting member 20. The outer head portion 48 is longer and wider than the inner neck portion 46, wider than the slot 42, and is attached at an upper end to an end wall 38B of the base portion 38 of the bracket member 22. Thus, the outer head portion 48 extends parallel to the base portion 38 of the bracket member 22, extends beyond opposite ends and opposite sides of the inner neck portion 48, extends beyond opposite side edges of the slot 42, and is insertable in the recessed channel 32, thereby adapting the outer head portion 48 for slidable movement therealong as the bracket member 22 is moved between the disengaged and engaged positions relative to the wall mounting member 20.

The mounting bracket assembly 20 also includes locking means 50 mounted on the latching member 44 for releasably locking the latching member 44 to the middle portion 28 of the wall mounting member 20. Specifically, the locking means 50 preferably includes a resilient flexible leaf spring 52 mounted to the outer head portion 48 by holes 54, 56 defined through an upper end of the leaf spring 52 and upper end of the outer head portion 48 by a screw 58 threadable through the holes 54, 56. The leaf spring 52 also has a dimple or protuberance 60 fixedly mounted to a lower end of the leaf spring 52 which is operable for releasably locking the outer head portion 48 of the latching member 44 to the middle portion 28 of the wall mounting member 20 by being extendable through apertures 62, 64 formed in the lower end of the outer head portion 48 of the latching member 44 and the lower end portion of the middle portion 28 below the elongated slot 42 of the wall mounting member 20. The apertures 62, 64 are aligned with one another when the bracket member 22 is disposed at the engaged position relative to the wall mounting member 22, as shown in FIG. 5.

The use of the leaf spring 52 can be omitted by removing it from the rear side of the outer head portion 48 of the latching member 44. Alternatively, a screw 65 can be threadably inserted through a hole 66 in the lower front end of the front wall 38A of the base portion 38 of the bracket member 22 and through the aligned apertures 62, 64 so as to retain the bracket member 22 in the engaged position relative to the wall mounting member 22. When the leaf spring 52 is used, it can be deflected to unlatch its protuberance 60 from the apertures 62, 64 by passing a nail, small punch or other slender tool through hole 66, deflecting the leaf spring protuberance 60.

It will be noted that since the base portion 38 of the bracket member 22 completely covers and conceals the wall mounting member 20, no paint trimming on the vertical wall surface 18 is required around the mounting member 20. Also, from the above description, it can be understood that there is a choice of three modes of use of the mounting bracket assembly 10: (1) with the locking leaf spring 52 in use; (2) with the locking leaf spring 52 omitted from use permitting free removal of the bracket member 22 from wall mounting member 20; or (3) with the locking leaf spring 52 omitted from use and instead the screw 65 threadably installed through the hole 66 in the base portion 38 of the bracket member 22. The mounting bracket assembly 10 can be applied to other uses also, such as a clothing hook or for hanging flower pots. In practice, the wall mounting member 20 is preferably made of steel material, while the bracket member 22 is preferably diecast.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A removable mounting bracket assembly, comprising:

(a) a wall mounting member adapted for attachment to a mounting surface;

(b) a bracket member having a base portion adapted to overlie and conceal from view said wall mounting member and an arm portion rigidly attached at an inner end to said base portion and extending in a cantilevered relationship therefrom to an outer end;

(c) complementary means respectively defined on said wall mounting member and on said base portion of said bracket member for releasably connecting said bracket member to said wall mounting member for converting said bracket member from a disengaged position to an engaged position relative to said wall mounting member to thereby convert said bracket member from a dismounted position to a mounted position relative to the mounting surface, said complementary connecting means including an elongated latching member capable of interfitting with said wall mounting member upon movement of said bracket member from said disengaged position to said engaged position relative to said wall mounting member; and (d) locking means for releasably locking said latching member to said wall mounting member, said locking means including (i) a pair of apertures defined respectively in said bracket member and said wall mounting member and being aligned with one another when said bracket member is disposed at said engaged position relative to said wall mounting member, and (ii) a flexible leaf spring mounted on said latching member and having a protuberance being extendable through said aligned apertures for releasably locking said latching member to said wall mounting member.

2. The bracket assembly of claim 1 wherein said wall mounting member includes:

a pair of spaced apart longitudinal side portions lying in a common plane so as to adapt said side portions for engagement against the mounting surface; and means for attaching of said wall mounting member at said side portions to the mounting surface.

3. The bracket assembly of claim 2 wherein said wall mounting member also includes a longitudinal middle portion extending longitudinally between and generally parallel to said side portions, said middle portion being disposed in a spaced offset relationship to the common plane of said side portions.

4. The bracket assembly of claim 3 wherein said wall mounting member further includes a pair of intermediate portions extending longitudinally between said middle portion and said side portions, said intermediate portions interconnecting said middle portion at opposite side edges thereof to said side portions at inner side edges thereof so as to dispose said middle portion in said spaced offset relationship to the common plane of said side portions.

5. The bracket assembly of claim 4 wherein said intermediate portions of said wall mounting member extend between and interconnect said offset middle and side portions in oppositely inclined relationships to one another from the common plane of said side portions.

6. The bracket assembly of claim 3 wherein said complementary connecting means also includes a slot defined longitudinally in said middle portion of said wall mounting member, said slot extending from an open upper end at a top edge of said middle portion to a closed lower end at a location spaced above a bottom edge of said middle portion.

7. The bracket assembly of claim 6 wherein said elongated latching member is capable of interfitting with said middle portion of said wall mounting member along said slot therein upon movement of said bracket member from said disengaged position to said engaged position relative to said wall mounting member.

8. The bracket assembly of claim 7 wherein said elongated latching member includes:

an inner neck portion extending along and rigidly attached to a longitudinal central region of said base portion of said bracket member for slidable movement along said slot of said middle portion upon movement of said bracket member between said disengaged and engaged positions relative to said wall mounting member; and an outer head portion being longer and wider than said inner neck portion such that said outer head portion extends beyond opposite ends and opposite sides of said inner neck portion and opposite sides of said slot and generally parallel to said base portion of said bracket member for slidable movement along said middle portion upon bracket member between said disengaged and engaged positions relative to said wall mounting member.

9. The bracket assembly of claim 8 wherein said leaf spring of said locking means is mounted on said outer head portion of said latching member.

10. A removable mounting bracket assembly, comprising:

(a) a wall mounting member having a pair of spaced longitudinal side portion adapted for attachment to a mounting surface and a longitudinal middle portion extending between and interconnecting said side portions;

(b) a bracket member having a base portion adapted to overlie and cover said wall mounting member and an arm portion rigidly attached at an inner end to said base portion and extending in a cantilevered relationship therefrom to an outer end;

(c) complementary means respectively defined on said middle portion of said wall mounting member and on said base portion of said bracket member for releasably connecting said bracket member to said wall mounting member for converting said bracket member from a disengaged position to an engaged position relative to said wall mounting member to thereby convert said bracket member from a dismounted position to mounted position relative to the mounting surface, said complementary connecting means including an elongated latching member capable of interfitting with said middle portion of said wall mounting member upon movement of said bracket member from said disengaged position to said engaged position relative to said wall mounting member; and (d) locking means for releasably locking said latching member to said middle portion of said wall mounting member to retain said bracket member at said engaged position relative to said wall mounting member, said locking means including (i) a pair of apertures defined respectively in said bracket member and said middle portion of said wall mounting member and being aligned with one another when said bracket member is disposed at said engaged position relative to said wall mounting member, and (ii) a flexible leaf spring mounted to said latching member and having a protuberance extendable through said aligned apertures for releasably locking said latching member to said middle portion of said wall mounting member.

11. The bracket assembly of claim 10 wherein said side portions of said wall mounting member lie in a common plane so as to adapt said side portions for engagement against the mounting surface, said side portions include means for attaching of said wall mounting member at said side portions to the mounting surface.

12. The bracket assembly of claim 11 wherein said middle portion of said wall mounting member is disposed in a spaced offset relationship to the common plane of said side portions.

13. The bracket assembly of claim 11 wherein said wall mounting member also includes a pair of intermediate portions extending longitudinally between said middle portion and said side portions, said intermediate portions interconnecting said middle portion at opposite side edges thereof to said side portions at inner side edges thereof so as to dispose said middle portion in said spaced offset relationship to the common plane of said side portions.

14. The bracket assembly of claim 13 wherein said intermediate portions of said wall mounting member extend between and interconnect said offset middle and side portions in oppositely inclined relationships to one another from the common plane of said side portions.

15. The bracket assembly of claim 10 wherein said complementary connecting means also includes a slot defined longitudinally in said middle portion of said wall mounting member, said slot extending from an open upper end at a top edge of said middle portion to a closed lower end at a location spaced above a bottom edge of said middle portion.

16. The bracket assembly of claim 15 wherein said elongated latching member is capable of interfitting with said middle portion of said wall mounting member along said slot therein upon movement of said bracket member from said disengaged position to said engaged position relative to said wall mounting member.

17. The bracket assembly of claim 16 wherein said elongated latching member includes:

an inner neck portion extending along and rigidly attached to a longitudinal central region of said base portion of said bracket member for slidable movement along said slot of said middle portion upon movement of said bracket member between said disengaged and engaged positions relative to said wall mounting member; and an outer head portion being longer and wider than said inner neck portion such that said outer head portion extends beyond opposite ends and opposite sides of said inner neck portion and opposite sides of said slot and generally parallel to said base portion of said bracket member for slidable movement along said middle portion upon movement of said bracket member between said disengaged and engaged positions relative to said wall mounting member.

18. The bracket assembly of claim 17 wherein said leaf spring is mounted on said outer head portion of said latching member.

* * * * *